US010589519B2

(12) United States Patent
Muth et al.

(10) Patent No.: US 10,589,519 B2
(45) Date of Patent: Mar. 17, 2020

(54) METHOD FOR DETECTING PRINTING NOZZLE ERRORS IN AN INKJET PRINTING MACHINE

(71) Applicant: HEIDELBERGER DRUCKMASCHINEN AG, Heidelberg (DE)

(72) Inventors: Frank Muth, Karlsruhe (DE); Jan Krieger, Heidelberg (DE); Wolfgang Geissler, Bad Schoenborn (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 48 days.

(21) Appl. No.: 15/604,917

(22) Filed: May 25, 2017

(65) Prior Publication Data

US 2017/0341371 A1 Nov. 30, 2017

(30) Foreign Application Priority Data

May 25, 2016 (DE) ..... 10 2016 209 083

(51) Int. Cl.
*B41J 2/045* (2006.01)
*B41J 2/21* (2006.01)
*B41J 29/393* (2006.01)

(52) U.S. Cl.
CPC ..... *B41J 2/0451* (2013.01); *B41J 2/04586* (2013.01); *B41J 2/2103* (2013.01); *B41J 29/393* (2013.01)

(58) Field of Classification Search
None
See application file for complete search history.

(56) References Cited

U.S. PATENT DOCUMENTS 6,057,882 A * 5/2000 van den Branden Lambrecht ..... H04B 17/0085 348/181
6,474,767 B1 11/2002 Teshigawara et al.
6,968,076 B1 11/2005 Ouyang et al.
8,322,814 B2 12/2012 Hirato et al.
(Continued)

FOREIGN PATENT DOCUMENTS

DE 69934626 T2 10/2007
DE 102011015603 B3 8/2012
EP 1034936 B1 7/2006

*Primary Examiner* — Alejandro Valencia
(74) *Attorney, Agent, or Firm* — Laurence A. Greenberg; Werner H. Stemer; Ralph E. Locher

(57) ABSTRACT

A method for detecting printing nozzle errors in an inkjet printing machine provides a high degree of robustness in the detection of errors by printing a nozzle test pattern in the inkjet printing machine. The test pattern is then digitalized by using a camera and transmitted to a computer for evaluation. There, the recorded test pattern is investigated by using methods of digital image processing, such as a Fourier analysis, and evaluated in the frequency range with regard to specific anticipated printing nozzle errors. Specific printing nozzle errors can be detected especially on the basis of amplitude, phase and variance errors in the signal in the frequency range. Moreover, by using the phase error, it is possible to evaluate whether the two print heads are disposed in an incorrect adjustment position relative to one another by calculating displacements of the phase error in transition regions of two print heads.

21 Claims, 7 Drawing Sheets

(56) References Cited

U.S. PATENT DOCUMENTS

| | | | | |
|---|---|---|---|---|
| 8,567,896 | B2 * | 10/2013 | Ueshima | B41J 2/04501 347/14 |
| 2005/0122364 | A1 | 6/2005 | Gardner et al. | |
| 2006/0214960 | A1 | 9/2006 | Chiwata | |
| 2009/0021552 | A1 | 1/2009 | Fletcher et al. | |
| 2011/0227988 | A1 | 9/2011 | Yamazaki | |
| 2011/0242187 | A1 * | 10/2011 | Mongeon | B41J 3/543 347/19 |
| 2013/0050329 | A1 | 2/2013 | Duke et al. | |

* cited by examiner

METHOD FOR DETECTING PRINTING NOZZLE ERRORS IN AN INKJET PRINTING MACHINE

CROSS-REFERENCE TO RELATED APPLICATION

This application claims the priority, under 35 U.S.C. § 119, of German Patent Application DE 10 2016 209 083.6, filed May 25, 2016; the prior application is herewith incorporated by reference in its entirety.

BACKGROUND OF THE INVENTION

Field of the Invention

The present invention relates to a method for detecting printing nozzle errors in an inkjet printing machine.

The invention lies in the technical area of digital printing.

In general, inkjet printing machines include one or more print heads and each print head includes a multiplicity of printing nozzles. Inkjet printing machines use the nozzles for printing by emitting ink. In the event of a failure of an individual printing nozzle, areas arise which, due to a failed nozzle, cannot be imaged in the individual color extraction, according to CMYK. Color-free points thus arise, which can appear as white lines. If a multi-color print is involved, the corresponding color is absent at that point and the color values become distorted. It should also be noted that the course of a jet from an individual nozzle does not run ideally, but rather can deviate therefrom to a greater or lesser extent, and furthermore the size of a jetted dot has to be taken into account. A malfunctioning nozzle thus affects the print quality of each printed document in which the malfunctioning nozzle contributes to the print image. The causes for the failure of individual nozzles are diverse, and it may involve a temporary failure or a permanent failure.

Several approaches towards compensation are known from the prior art in order to reduce the effects on the print image. In one of the most commonly employed approaches, an attempt is made to cover the error by using other nozzles in the same color and the same inkjet unit. That is to say that, to compensate for individual failed inkjet printing nozzles after ascertaining which individual nozzle is involved, the adjacent nozzles are driven in such a way that the dot sizes of those nozzles are enlarged so that the point of the failed nozzle is also covered. The adjacent nozzles thus combine to write the image of the failed nozzle. White lines arising due to the non-printing individual nozzles can thus be prevented.

Another known approach resides in replacing the failed printing nozzle by the nozzles of the respective other print color inks used at the same point. An attempt is made in that case to approach the failed print color as closely as possible by targeted and controlled overprinting of the colors that are still available. Thus, neither redundancy of printing nozzles or print heads is required, nor does the failure of adjacent printing nozzles present a problem. The main drawback with that method of compensation, however, is that it can only be used for multicolor printing. In addition, there is an increased computing and control requirement by the computer of the printing machine in order to ascertain the required color combinations. Moreover, the resultant print can possibly deviate quite markedly from the setpoint values—depending on the color distance of the failed color from the still printable color space of the remaining colors.

Other approaches to compensate for failed printing nozzles provide double nozzle units in the same color so as to compensate for the failure of individual nozzles by way of redundancy. Or a plurality of positionable print heads are used to print an image. If printing nozzles fail, the print heads are repositioned in order to replace the failed nozzle in the best possible way. In the case of both approaches, a redundancy of print heads of the same color is de facto required, which is accompanied by a correspondingly increased construction outlay.

The prerequisite for such a compensation, however, is first and foremost the correct detection of a failed printing nozzle. That is to say that it not only has to be detected that such a failure has occurred, but it is also necessary to recognize precisely which printing nozzle is involved, since most known compensation methods require precise knowledge of the non-functioning printing nozzles.

Various approaches to a method for the detection are known from the prior art.

One approach to a method resides in printing test print images. Those print images are then evaluated, i.e. counted out, by a machine operator and the information concerning any failed nozzles is communicated to the machine by a manual input. On the basis of that information, a new print image is produced, in such a way that the failed nozzles are compensated for. That process cannot be carried out in parallel. An error in the print image first has to be detected in order to then initiate the described manual process. An inspection is required, which leads to a loss of production time. In addition, it does not involve an automatic detection, which can possibly cause a volume of paper wastage. Examples of such test patterns are known from U.S. Patent Application Publication US 2011/227988 A1 and U.S. Pat. No. 8,322,814 B2.

Those test patterns can also be used for purposes other than simply detecting failed printing nozzles. Thus, an inkjet test pattern for determining print head alignment error correction values for an inkjet hardcopy apparatus is known from European Patent EP 10 34 936 B1. The test patterns contain optically readable, individually spaced test pattern objects, which are disposed in order to form a plurality of regions on the print medium, which include a first region for acquiring reflectance value data that indicates x-axis error correction values, a second region for acquiring reflectance value data that indicates y-axis error correction values, a third region for acquiring reflectance value data that indicates error correction values in a column-to-column spacing of nozzle sets which fire an identical color ink from different nozzle columns of a single print head, a fourth region for acquiring reflectance value data that indicate primitive-by-primitive error correction values, and a fifth region for acquiring reflectance value data that indicate x-axis error correction values of bidirectional variable-speed printing.

The use of such test patterns, however, usually takes place separately from the actual printing jobs, which leads to an increased paper wastage, as well as poorer utilization of the printing machine. Furthermore, for the purpose of detecting failed printing nozzles and for the purpose of the print head alignment, for example, different test patterns and methods for their use are known from the prior art. A common method covering all of those uses would however be much more efficient than the use of different individual methods. In addition, the methods for the use and evaluation of those test patterns known from the prior art are still in need of further improvement in terms of quality.

SUMMARY OF THE INVENTION

It is accordingly an object of the invention to provide a method for detecting printing nozzle errors or failures in an inkjet printing machine, which overcomes the hereinaforementioned disadvantages and drawbacks of the heretofore-known methods of this general type in terms of lack of performance and in addition also delivers parameters for further configurations of the inkjet printing machine, such as the alignment of the print heads.

With the foregoing and other objects in view there is provided, in accordance with the invention, a method for detecting printing nozzle errors in an inkjet printing machine by using a computer, the method comprising the following steps:

- printing of a nozzle test pattern
- determining the precise positions of the individual components of the nozzle test pattern
- acquiring and recording or photographing the nozzle test pattern by using at least one camera
- producing an actual signal from the printed and acquired nozzle test pattern
- carrying out a Fourier analysis by using the generated actual signal
- generating a reference signal with the location frequency of the Fourier-transformed actual signal
- generating a correlation signal from the reference and actual signal, wherein the correlation signal describes valid setpoint positions for specific points of the nozzle test pattern
- eliminating all positions at the edges of the correlation signal that do not correspond to any setpoint positions
- displacing the reference signal to each of the setpoint positions, as a result of which a working point arises
- calculating amplitude and/or phase and/or variance errors from an evaluation of the signal course of the actual signal around the given working point and
- evaluating the printing nozzle quality from the calculated amplitude, phase and variance errors.

The method according to the invention is distinguished by a high degree of robustness in the detection of errors. This is achieved by the fact that a nozzle test pattern is printed in the inkjet printing machine to be investigated. The test pattern is then digitalized by using the camera and transmitted to a computer for evaluation. There, the recorded or photographed test pattern is investigated by using methods of digital image processing, such as for example a Fourier analysis, and evaluated in the frequency range with regard to specific anticipated printing nozzle errors. Specific printing nozzle errors can be detected especially on the basis of amplitude, phase and variance errors in the signal in the frequency range.

A preferred development is that the nozzle test pattern includes a specific number of horizontal rows of periodically vertically printed, equidistant lines, which rows are disposed below one another and limited by horizontal lines, and that, in each row of the nozzle test pattern, the printing nozzles that correspond to the specific number of the horizontal rows contribute only periodically to the nozzle test pattern. In a particularly suitable variant of the nozzle test pattern, the latter includes vertically printed equidistant lines. It is also important that the latter are produced in a specific number of horizontally disposed rows. Only printing nozzles of a specific order are used per row. For example, only the first, eleventh, twenty-first printing nozzles and so forth are used in the first row, so that ultimately only the tenth printing nozzles print respectively in each row. This is necessary, since at least the currently used cameras still have a lower resolution than the employed inkjet print heads are capable of printing. However, even with a higher camera resolution, this method has the advantage that individual printing nozzles with a corresponding greater spacing from one another can thus be more easily identified than in the case of a test print with all of the printing nozzles in a row. The respective second or third printing nozzles can of course also print in the first row. The assignment merely has to be known. The spacings can of course also be changed. Thus, for example, every twentieth or every second nozzle can also print. In the first case, the number of the required rows increases however to twenty, since all of the printing nozzles naturally have to print at least once in the test pattern. In the second case, two rows would suffice.

Another preferred development is that the positions of the individual nozzle test patterns are determined by the detection of the horizontal lines and averaging over the vertical lines. In order to generate an evaluatable signal from the printed test pattern, the positions of the individual nozzle test patterns are determined by a detection of the limiting horizontal lines and averaging of the vertical lines. A signal distribution that can be evaluated for further analysis thus results on the basis of the color values of the stated positions.

A further preferred development is that the nozzle test pattern includes horizontal rows of printed patterns with a monotonic autocorrelation function. The test pattern can also include horizontal rows of printed patterns disposed below one another and a monotonic autocorrelation function. These patterns are very well suited for measuring spacings in a precise manner and, as a result of the correlation, information concerning the entire image region that has been detected also flows into the evaluation, as a result of which local errors in the pattern have only a slight effect on the measurement result. Displacements in the Y- (and X-) direction can also be detected with special patterns from radar technology. These patterns have the advantage that their autocorrelation functions are monotonic. The patterns are therefore suitable for measuring spacings in a precise manner. Measurements in the local region on local strokes are much more error-sensitive.

An added preferred embodiment is that the patterns include Barker codes with positive end values respectively at the beginning and end of a horizontal row. A special kind of patterns that is particularly well suited for the use are so-called Barker codes. In order to be used as a nozzle test pattern, the Barker codes being used must have positive end values respectively at the beginning and the end of a horizontal row. This is due to the fact that, in the case of printed patterns, the positive end values of the correspondingly printed Barker codes mark the beginning and the end of the horizontal row. If, as for example for use in radar technology, a negative end value of the Barker code were to stand at the beginning or end, it would no longer be possible to detect where the printed pattern begins and ends.

An additional preferred development is that the pattern is a two-dimensional pattern, which is formed by two Barker codes that are perpendicular to one another. When use is made of two Barker codes that are perpendicular to one another, a two-dimensional pattern thus results that can be used both for the x and also for the y stitching. This means that, when use is made of a two-dimensional Barker code, not only can occurring printing nozzle errors be ascertained, but also deviations in the positioning of the print heads can be detected. When use is made of two-dimensional Barker codes, a rotation of the print head in the hypothetical z direction can be detected, apart from the x and y stitching, i.e. apart from the deviations of the print head in the x and y direction.

Yet another preferred embodiment is that the patterns include Neumann-Hoffman sequences with positive end values respectively at the beginning and end of a horizontal row. As an alternative to Barker codes, use can also be made of patterns including Neumann/Hoffmann sequences, also with positive end values respectively at the beginning and end of the horizontal row.

Yet an added preferred development is that a nozzle test pattern is printed for each print color involved in the printing process and the nozzle test patterns thus produced are disposed below one another to form a total test pattern. In the case of a multi-color print being used, a corresponding printed test pattern must of course be printed for each print color involved in the printing process. The latter are then disposed and joined together to give a total test pattern.

Yet an additional preferred development is that the actual signal is generated by averaging all of the horizontal rows of the nozzle test pattern and an interpolation of the actual signal is then carried out, including a reduction of artifacts arising due to the geometrical quantization by using sub-pixeling. After the generation of the actual signal by averaging all of the horizontal rows of the nozzle test pattern, an interpolation is carried out which is required to compensate for arising information gaps which have arisen in the generation due to the transformation of the digitalized and detected nozzle test pattern. A Fourier analysis of the generated actual signal with information gaps continuing to be present would reduce the efficiency of the method according to the invention and possibly cause pseudo-errors.

Again another preferred development is that the amplitude error includes the ratio of the maximum values of the setpoint signal and the actual signal, and a detection of missing or faintly-printing printing nozzles is possible by an evaluation of the amplitude error. Missing or faintly-printing printing nozzles can in particular be found by averaging the amplitude errors. The greater the deviation of the amplitude error from the actual signal, the worse the printing nozzle assigned to the corresponding point in the signal works, or it no longer works at all.

Again a further preferred development is that the phase error describes the deviations of the emphases, in the form of equivalently segmented regions, of the setpoint and the actual signal, and a detection of an obliquely jetting printing nozzle is possible by evaluating the phase error. On the basis of the phase error, it is again possible to establish whether or not a printing nozzle is possibly jetting obliquely. The greater the phase error, the greater the deviation of the obliquely jetting printing nozzle usually is.

Again an added preferred development is that a position determination of at least two print heads is carried out from the phase error by calculating displacements of the phase error in the transition regions of the at least two print heads, so that, with this position determination, an evaluation of the print head positions in terms of an incorrect adjustment position of the at least two print heads is possible. A further area of application can also be covered by using the phase error. By calculating displacements of the phase error in the transition regions of two print heads, the so-called stitching region, it is possible to evaluate whether or not the two print heads are disposed in an incorrect adjustment position relative to one another. Thus, a correction of a possible incorrect adjustment position can then be calculated and thus carried out. An evaluation with a freely mobile external imaging measurement device has the drawback that a geometrical relation between the measurement device and the print heads is undefined. The print heads of a digital printing machine must be aligned relative to one another perpendicular to the printing direction (x-stitching), in the printing direction (y-stitching) and in their angular orientation (z-rotation). Furthermore, the individual color extractions must be registration-accurate relative to one another. All information for the adjustment must be contained in an image. For the x-stitching and y-stitching, these are strokes from the transition region between two adjacent print heads. For the z-rotation, they are parallel strokes from the core region of a print head. Photographs with a video magnifier produce only small image segments. The required high number of photographs makes the method susceptible to error and complicated. The limited image segment requires a high resolution to achieve the required accuracy for the adjustment. An inkjet digital printing machine such as JayHawk or Summit includes up to seven print beams, in which up to 25 inkjet print heads are disposed beside one another. Each print beam supplies the printing machine with an ink. The print heads have a high resolution of 1200 DPI and cover only a region of a few centimeters. Due to the construction, nozzles from adjacent print heads overlap, which however does not play any part in the invention. Through the use of suitable measurements, an upstream adjustment process must first align the print heads relative to one another geometrically in a mechanical and electronic manner. Only in this way is it ensured for the subsequent printing that raster images without geometrical errors are transferred onto the printing substrate. The (line) cameras available in digital printing machines and the digital print heads themselves are produced on the basis of electrophotographic processes. These processes produce geometrically highly precise structures. The structures can however also be used as highly accurate scales for setting up the print heads. The invention uses these precise geometrical structures in a targeted manner in combination with particularly suitable forms of the digital signal evaluation.

Again an additional preferred development is that, for the position determination of the at least two print heads, a displacement of the base signal values in the generated Fourier-transformed signal in the transition region is detected, wherein a deviation of the adjustment positions of the two print heads disposed beside one another arises from the numerical displacement of the base signal values in the generated Fourier-transformed signal. The position determination of the print heads can be detected by a displacement of the base signal value in the transition region in the generated Fourier-transformed signal. The greater this displacement is numerically, the more the adjustment positions of the two print heads disposed beside one another diverge from one another. By evaluating the signal displacement in the stitching region, the print heads can thus be correspondingly adjusted. It is important, however, that the optics of the camera, which records and digitalizes the nozzle test pattern in the stitching region, is sufficiently accurate, since the displacement of the base signal values is only very small.

Still another preferred development is that the position determination of the at least two print heads is detected by a displacement of the base signal values in the generated Fourier-transformed signal in the transition region, wherein a deviation of the adjustment positions of the two print heads disposed beside one another is calculated from the phase error and a filter for the correlation signal. If the optics of the camera is not sufficiently precise, the displacement of the signal cannot be determined by way of comparisons of the inner regions (stitching) of adjacent print heads. The influence of the imprecise optics over a large distance is then too great. As an alternative, the position determination by a calculation from the phase error and the filter for the correlation is advisable in this case.

Still a further preferred development is that the determined print head positions are used for the adjustment correction of the at least two print heads perpendicular to the printing direction, corresponding to a hypothetical x-axis, and/or in the printing direction, corresponding to a hypothetical y-axis, and/or in an angular orientation, corresponding to a hypothetical z-axis. For the adjustment correction of the print heads perpendicular to the printing direction, the ascertained print head positions corresponding to a hypothetical x-axis are used, for the correction of the position of the two print heads in the printing direction, those corresponding to a hypothetical y-axis, and for the angular orientation, those corresponding to a hypothetical z-axis.

Still an added preferred development is that the adjustment correction of the at least two print heads perpendicular to the printing direction and in the angular orientation is brought about by a mechanical displacement of the at least two print heads, whereas the adjustment correction of the at least two print heads in the printing direction takes place electronically by a time-delayed output of the printing data to the at least two print heads. The adjustment correction perpendicular to the printing direction and in the angular orientation takes place by a mechanical displacement of the at least two print heads. This means that the geometrical position of the print heads in space is actually changed in this case by using a suitable device. The adjustment correction in the printing direction, on the other hand, takes place electronically by using a time-delayed output of the printing data. The geometrical position of the print heads is not changed in this case.

Still an additional preferred development is that, for the adjustment correction of the at least two print heads perpendicular to the printing direction and in the printing direction, the periodically vertically printed, equidistant lines, i.e. the printed patterns with monotonic autocorrelation function in the transition region between two print heads, are evaluated, in the case of the adjustment correction of the at least two print heads in the angular orientation, on the other hand, the periodically vertically printed, equidistant lines, i.e. the printed patterns with the monotonic autocorrelation function in the core region of the at least two print heads, are evaluated. For the adjustment correction of the two print heads perpendicular to the printing direction and in the printing direction, the nozzle test patterns or the generated Fourier-transformed signals corresponding thereto in the transition region between two print heads must be evaluated, as already mentioned. In the case of the adjustment correction in the angular orientation, on the other hand, the corresponding regions in the core region of the nozzle test patterns or the signals generated therewith have to be used.

Another preferred development is that the acquisition and recording of the nozzle test pattern takes place by using a plurality of sub-cameras, the individual images resulting therefrom constituting the basis for the method for detecting printing nozzle errors, wherein the magnitudes required for the method are determined directly from the individual sub-images. The acquisition and recording of the nozzle test patterns usually take place by using a plurality of sub-cameras. The individual images thereby arising do not have to be combined to form a total image as is required to some extent in the prior art, which in turn represents an additional source of error, but rather they can be used in the form of a single evaluation of the sub-images as a basis for the method for detecting printing nozzle errors. The magnitudes required for the method can be determined directly from the individual sub-images. The known drawbacks from the prior art, moreover, lie in a limited accuracy due to a subpixel-accurate interpolation of the sub-images. For a measurement of spacings for an adjustment of elements in the digital printing machine, combining of the sub-images is not required and takes up unnecessary computing time. Processing of individual sub-images can be parallelized more easily on memory-coupled multi-processor or multi-core computers. An image evaluation in a large-format digital printing machine usually takes place with a plurality of (line) cameras. The cameras have a limited number of pixels. The available installation space together with an acceptable optical opening angle then leads to the use of a plurality of cameras with a specific and required resolution. The invention resides in evaluating the individual images of the cameras separately from one another without first creating a total image including sub-images.

A further preferred development is that the individual sub-images are geometrically coupled to one another by using printed reference marks, at least one reference mark being present in each sub-image and the reference marks at the same time being used as a pattern for a reference system for the geometrical calibration of the sub-camera. Since the generated sub-images can also constitute segments of the nozzle test pattern without a test pattern end and test pattern beginning that can be unequivocally identified, reference marks are printed in the test patterns which are distributed with a frequency and coordination which is such that at least one reference mark is present in each sub-image. A reference system for the geometrical calibration of the cameras can be established with these reference marks. In addition, the individual sub-images can be geometrically coupled with one another by using the reference marks, since each sub-image can thus be precisely assigned to a specific position in the nozzle test pattern. The reference marks can be printed on the same sheet as the measurement marks or on another sheet. The reference marks can be integrated in a measurement mark or can be located outside a measurement mark. Each camera sees a reference mark in its entirety. The reference mark can be located in the overlapping regions of two cameras or in the non-overlapping region. Due to the use of a robust integration of a reference mark into the print, a separate geometrical calibration of the imaging devices is not necessary. If the reference and measurement marks lie in an image, sub-images can be evaluated independently of one another.

An added preferred development is that the printed reference mark includes a circle, wherein the center point and the diameter of the circle are fitted by using the detected edge pixels thereof using a regression method. A circle has proved to be the preferred form for the printed reference mark. The so-called circle-fit method is used for the position determination of the reference mark. The diameter of the circle is fitted and the center point is determined by regression of the detected edge pixels of the individual mark.

An additional preferred development is that the reference mark contains information from a plurality of printing nozzles, wherein the plurality of printing nozzles belong to a single print head. Due to the fact that the reference mark is printed by a plurality of printing nozzles, defective printing nozzles that are responsible for the printing of a corresponding reference mark have fewer effects on the position determination by using the reference mark. As a result of the fact that only printing nozzles of a single print head are used for the printing of a respective reference mark, adjustment errors between the print heads also no longer play any part.

A concomitant preferred development is that the printed reference mark is integrated into a printed measurement mark for the color measurement and/or for the register control. The integration of the reference mark into a printed mark for the color measurement or the register control has the advantage that these marks, which in any case have to be printed, can at the same time be used for the measurement of the geometrical properties. Separate printing and detection of the reference mark is therefore no longer necessary. Only the evaluation of the integrated reference mark still of course has to be carried out.

The method according to the invention and functionally advantageous developments of the method are described in greater detail below by reference to the associated drawings on the basis of at least one preferred example of embodiment.

Other features which are considered as characteristic for the invention are set forth in the appended claims.

Although the invention is illustrated and described herein as embodied in a method for detecting printing nozzle errors in an inkjet printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
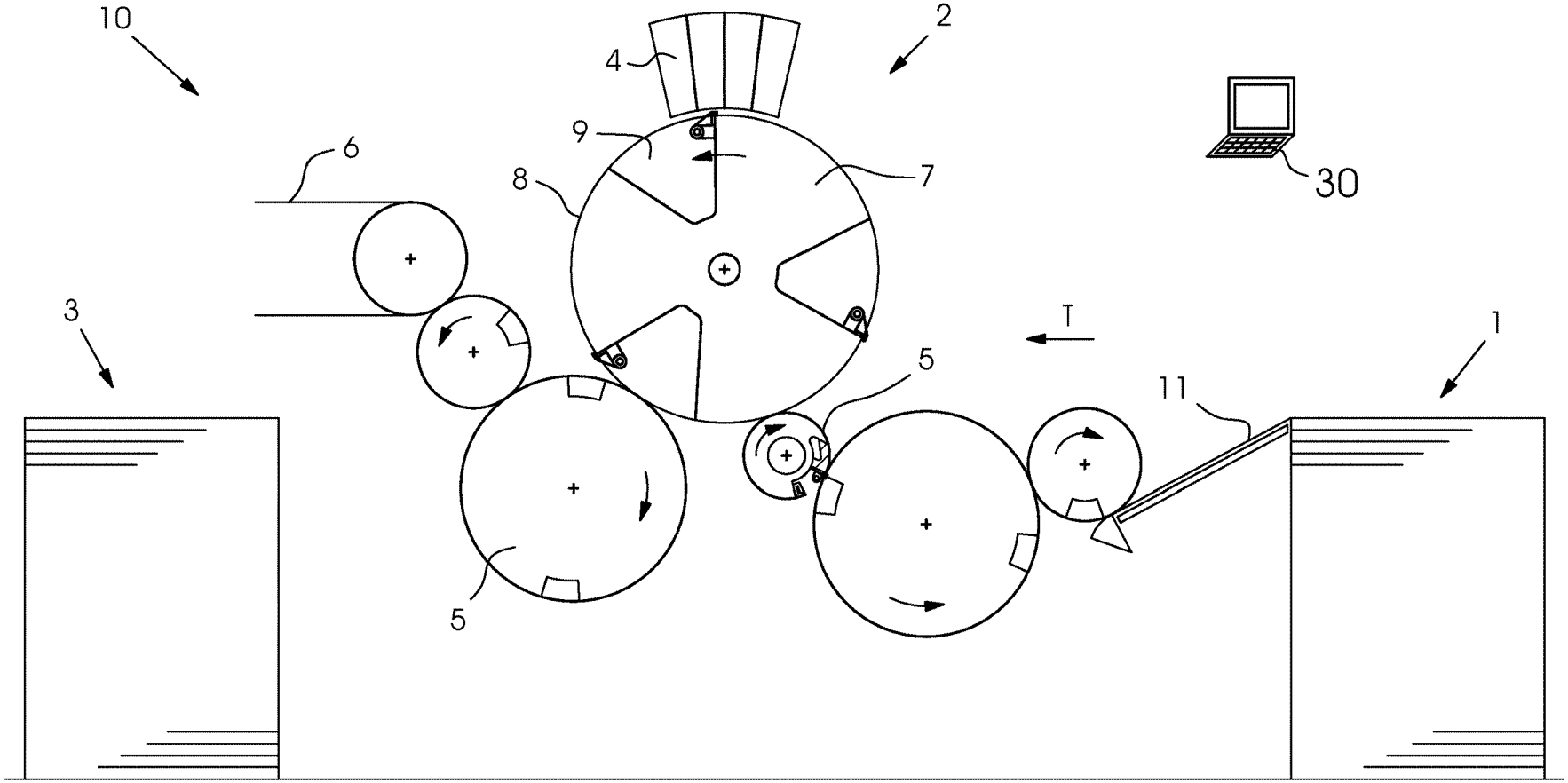
FIG. 1 is a diagrammatic, longitudinal-sectional view of a sheet-fed inkjet printing machine.

Referring now to the figures of the drawings in detail and first, particularly, to FIG. 1 thereof, there is seen a preferred embodiment in which the area of application is a digital printing machine constructed as a sheet-fed inkjet printing machine 10. An example of the construction of such a machine 10 is represented in FIG. 1. A respective sheet 11 is transported from a feeder 1 in a transport direction T through a printing unit 2 and a drive 6 to a delivery 3. The transport of a respective sheet 11 takes place primarily by using cylinders, i.e. transfer cylinders 5 and a printing cylinder 7. Inkjet print heads 4, which are disposed above the printing cylinder 7, print a sheet 11 which is moved past at a small spacing by the printing cylinder 7. The printing cylinder 7 is therefore also referred to as a jetting cylinder. In the illustrated embodiment, the printing cylinder 7 has three sheet retaining zones 8, which are separated from each other by a respective channel or gap 9.

Figure 2:
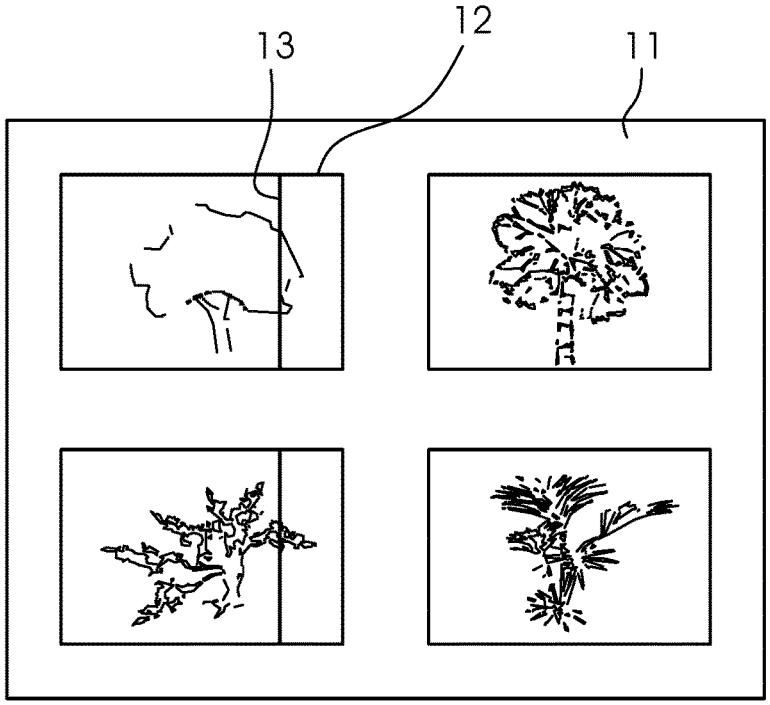
FIG. 2 is a plan view of a sheet showing an error image caused by a printing nozzle failure.

When the printing machine 10 is operated, failures of individual printing nozzles in the print heads 4 in the printing unit 2 can occur, as already described at the outset. The consequences then are white lines 13, or in the case of a multicolor print, distorted color values on a print image 12. An example of such a white line 13 is represented in FIG. 2.

Figure 3:
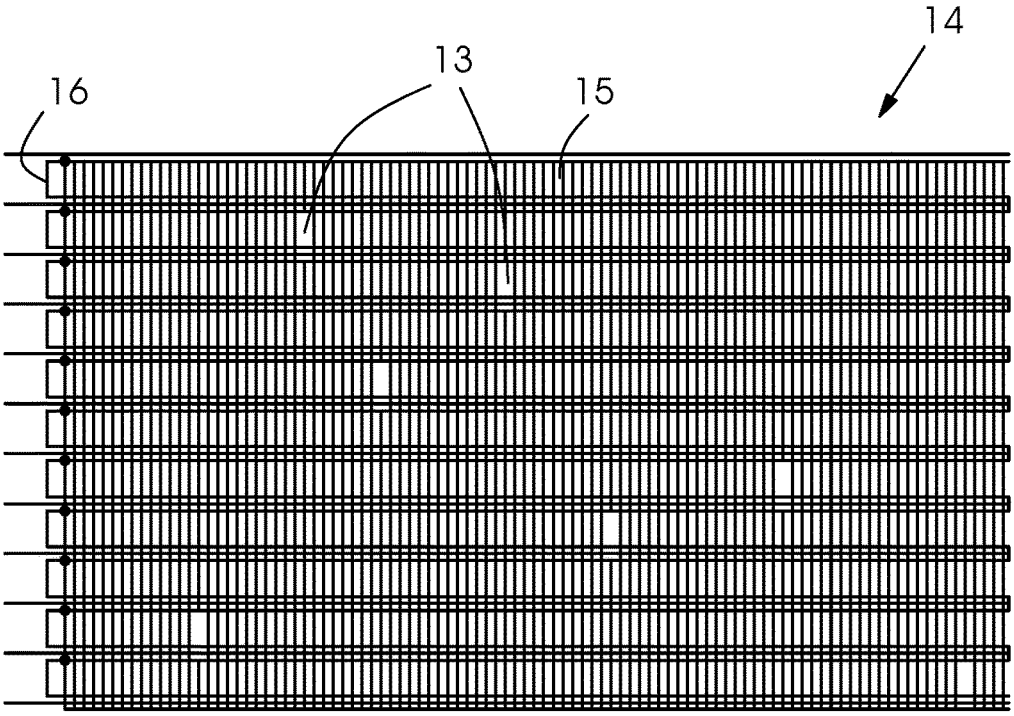
FIG. 3 is a nozzle test pattern for a printing ink.

The method according to the invention permits a determination and classification of deviations during printing in the inkjet process. Due to tolerances from manufacture and foreign bodies in the ink, deviations in printing usually occur with all heads 4. Nozzles can completely fail, jet obliquely or in an undefined manner or deposit ink in different thicknesses. Therefore, in order to provide a high-quality print, it is crucial for these errors 13 to be precisely detected and for this information to be sent to a controller, control system or computer 30 of the digital machine 10. The controller 30 is then able in many cases to correct such errors 13 by compensation with ink from adjacent nozzles. An integration of an automatic method for detecting nozzle errors 13 with a feedback to the digital controller 30 is therefore an important element of a digital printing machine 10 and is also known. The method is geared to the known patterns from nozzle monitoring. FIG. 3 shows an example of such a pattern 14 for a specific print color. The pattern 14 is distinguished by equidistant vertical lines 15, which are printed for each color. During the printing by every 10th nozzle, 10 lines with vertical strokes must be printed in order to print with all of the nozzles. In the first line, for example, the first nozzles would be printed {1, 11, 21, . . . }, in the second line all of the second nozzles {2, 12, 22, . . . } etc.

The method according to the invention is geared to the structure of nozzle patterns 14 and includes the following steps:

1. The position of the pattern 14 is known as a surrounding rectangle on sheet 11 with a small degree of uncertainty. The pattern 14 is limited by horizontal lines 16. During the printing of every n-th nozzle, n patterns 14 are required in order to print all of the nozzles once. All n patterns 14 do not always have to be printed on one sheet. A plurality of patterns 14 form a block. Patterns 14 are placed seamlessly in a row in a block. A block or an individual pattern 14 is separated by a white edge from the subject.

2. A first step determines the precise positions of the individual patterns on the basis of horizontal lines 16. For this purpose, the method averages different vertical lines. The grey-scale value of the color thus clearly appears at points of the horizontal lines. The points between the horizontal lines are less intensely saturated with the paper white due to averaging. An averaged signal 17 can be robustly evaluated by way of a differential filter in order to detect the positions of horizontal lines 16.

Figure 4:
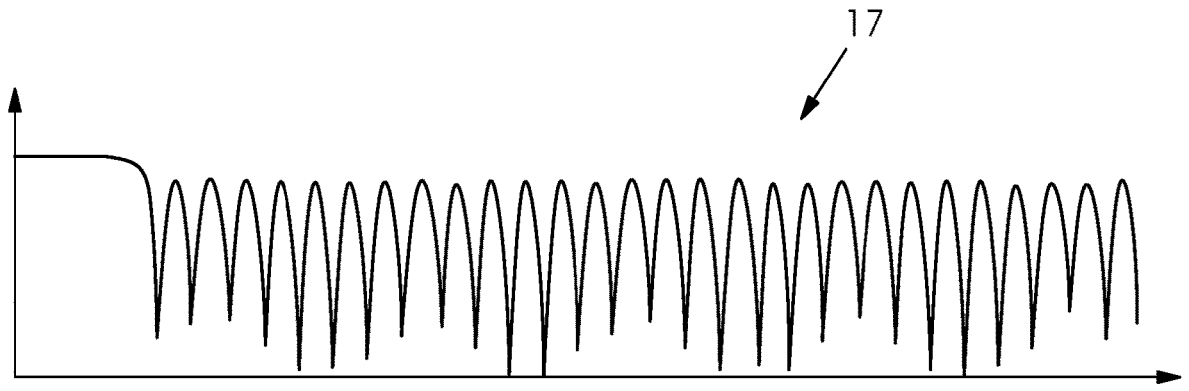
FIG. 4 is a diagram of an averaged original signal.
Figure 5:
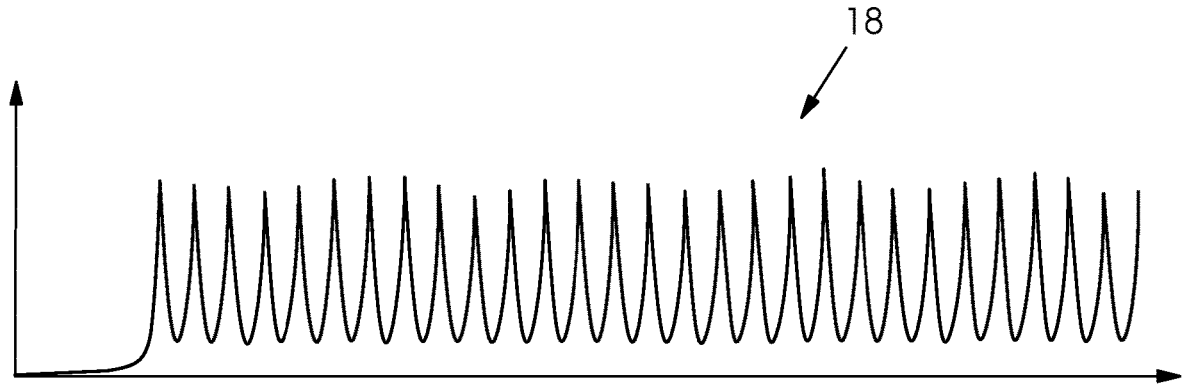
FIG. 5 is a diagram of an interpolated original signal.

3. The method then averages for each pattern all of the horizontal lines to form an actual signal. The overall result is thus a reduction in the signal noise. The total signal is interpolated, since the camera resolution is less than the inkjet resolution and, by using sub-pixeling, artifacts are reduced by a geometrical quantization. For each color, a suitable color channel is selected for the evaluation. Thus, for example, the green channel is taken for the color black. For black, i.e. K, the two other color channels would however also be possible. For the scale colors cyan, magenta and gold, on the other hand, the signal of the respective complementary color is taken. FIG. 3 shows the detected regions in the individual patterns with vertical lines. The averaged original signal 17 is shown in FIG. 4. In FIG. 5, this original signal is interpolated 18.

4. The averaged signal 18 undergoes a Fourier analysis. The equidistant vertical lines in the pattern generate a pronounced local frequency in the frequency domain.

5. A longer reference signal can be generated with this local frequency. The reference signal has an uneven number of extremes. The working point of the reference signal is then the average extreme value.

6. The algorithm then correlates the reference signal and the actual signal. The periodic correlation signal describes valid setpoint positions for the vertical lines. If the reference signal has been selected sufficiently long, local nozzle errors do not have a great effect on the setpoint positions.

Figure 6:
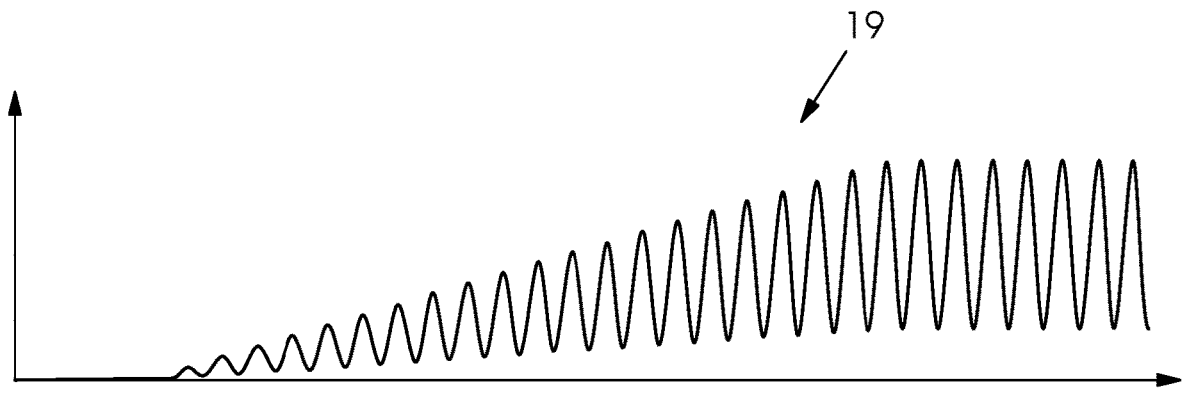
FIG. 6 is a diagram of a start of an FT correlation signal.

7. At the edges of the correlation signal, positions are eliminated that do not correspond to any setpoint positions. These positions arise due to the length of the reference signal and the periodic structure of reference signal and actual signal. FIG. 6 shows the start in a correlation signal 19.

Figure 7:
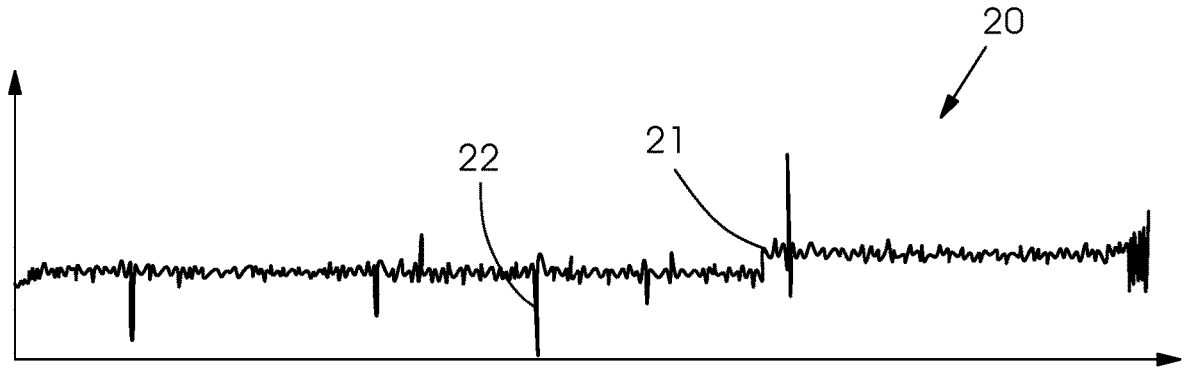
FIG. 7 is a phase error diagram of an FT actual signal.
Figure 8:
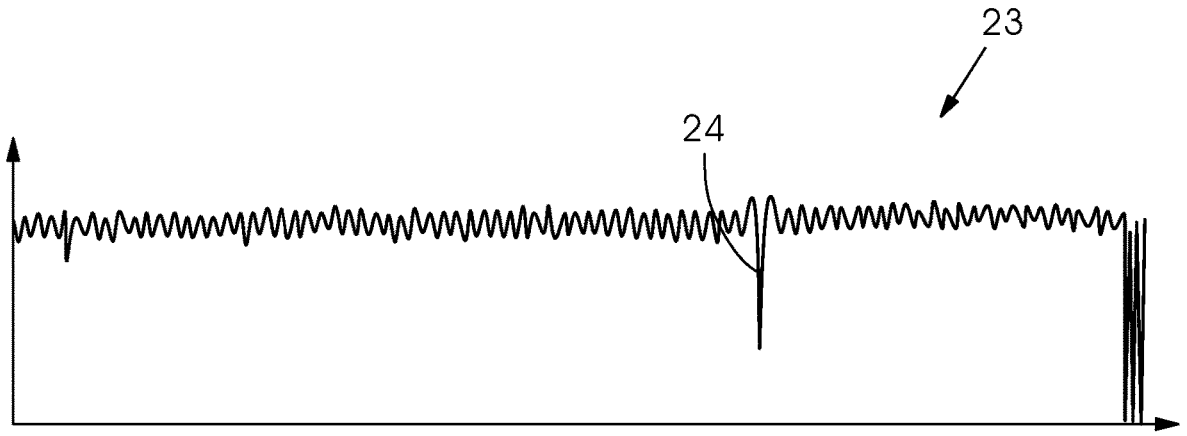
FIG. 8 is an amplitude error diagram of an FT actual signal.

8. The reference signal is then displaced to each setpoint position. The method evaluates the signal course in the actual signal around the working point and basically calculates three characteristic variables:

a) The deviation of the emphases of equivalently segmented regions of the setpoint signal and the actual signal. This deviation is a phase error 22. Obliquely jetting nozzles can be detected with the phase error. FIG. 7 shows such phase errors 22 in a corresponding phase error diagram 20.

b) The ratio of the maximum values of the setpoint signal and the actual signal permits a robust detection of missing or faint nozzles. This error is referred to as an amplitude error 24. The amplitude errors 24 can be seen in FIG. 8 in an exemplary amplitude error diagram 23.

c) An investigation of the scatter of the distribution of the actual signal delivers a further characteristic variable for assessing possible nozzle errors. This error is known as a variance error.

9. Since the resolution of the print head is known exactly and the resolution is retained during printing, enlargement of the camera system can also be determined with the pattern at the same time. The phase error 22 can thus be converted into a metric unit.

10. It is then possible to subject the phase error 22, the amplitude error 24 and the variance error to a robust signal evaluation in order to ascertain significant deviations. The filtering with an averaged absolute deviation from the median (median absolute deviation) delivers a robust assessment of the general signal scatter. If the measured values exceed this limit significantly, the latter are then candidates for possible errors.

A further, eleventh step also includes a trend adjustment of the averaged values in order to duly take into account individual deviations and measurement errors.

Furthermore, in a further preferred embodiment variant, no vertically printed, equidistant lines are used for printing nozzle patterns 14, but rather special patterns having autocorrelation functions which are monotonic. These patterns are suitable for measuring spacings precisely, since correlations have the advantage that information concerning entire image areas flows into the result and local errors have only a slight effect on the measurement result. Measurements in the local region at local, vertically printed, equidistant lines, on the other hand, are much more error-sensitive. However, influences of the distortion need to be taken into account, since the correlation patterns extend over a larger area.

A class of known patterns is the so-called Barker codes 34. Suitable Barker codes 34 must be delimited by color at the ends for printing. Only Barker codes 34 with positive values at both ends thus come into consideration. In contrast with electronic signals with positive and negative components, only color or no color is possible as a signal carrier in printing. The following table shows possible examples of Barker codes 34 to be used:

| Length | Code | S/R to secondary maxima | printable |
|---|---|---|---|
| 2 | +1−1 | −6.0 dB | no |
| 3 | +1+1−1 | −9.5 dB | no |
| 4 | +1+1−1+1 | −12.0 dB | yes |
| 5 | +1+1+1−1+1 | −14.0 dB | yes |
| 7 | +1+1+1−1−1+1−1 | −16.9 dB | no |
| 11 | +1+1+1−1−1−1+1−1−1+1−1 | −20.8 dB | no |
| 13 | +1+1+1+1+1−1−1+1+1−1+1−1+1 | −22.3 dB | yes |

Figure 11:
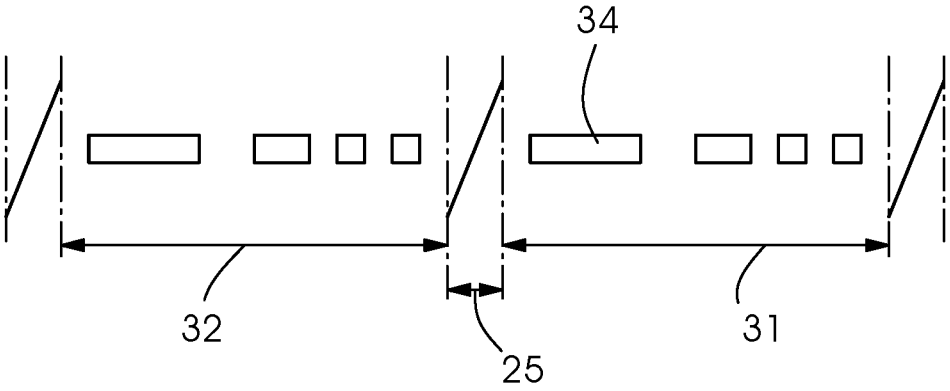
FIG. 11 is a diagram of printed Barker sequences of two print heads.
Figure 12:
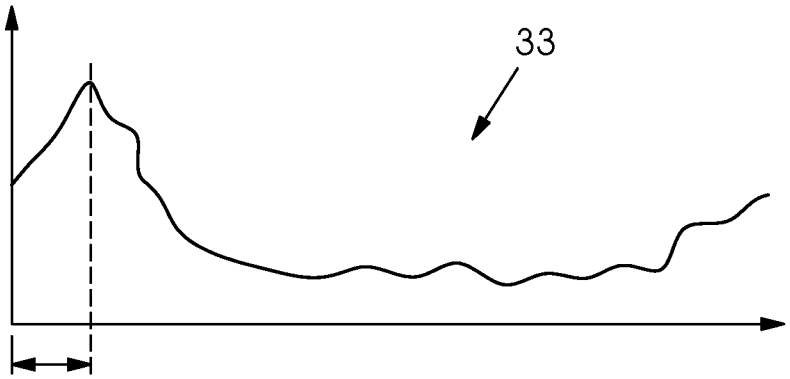
FIG. 12 is a diagram of a correlation of two Barker sequences.
Figure 13:
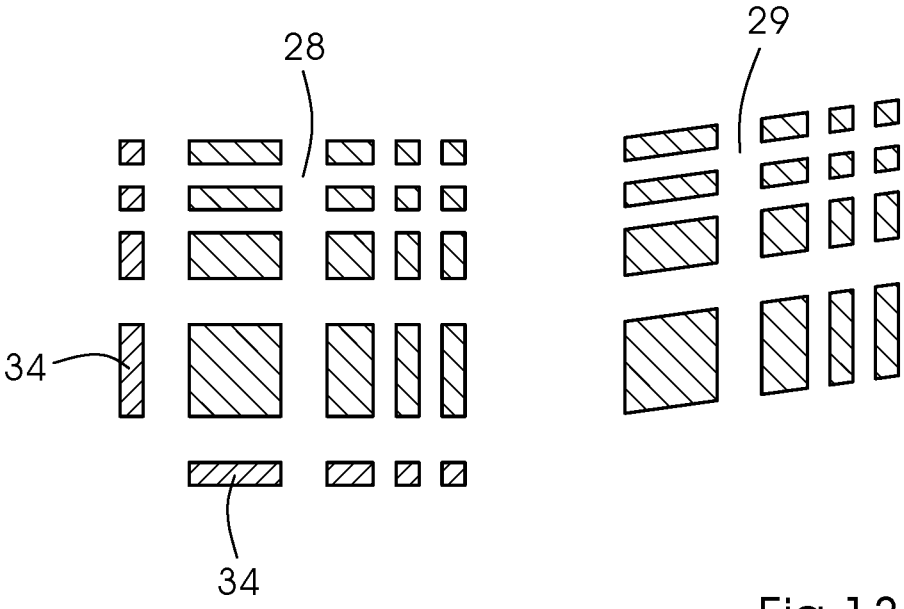
FIG. 13 is a diagram of printed 2D-Barker sequences, normal and sheared.

Alternative codes from radar technology with similar properties of monotonic autocorrelation functions are the Neuman-Hoffman (NH) sequences. Finally, all of the codes are distinguished in that the correlation functions have unique maxima, which markedly simplifies a signal evaluation. These patterns can be fitted into the central region of a print head 4. The central region contains 1920 nozzles and lies next to the transition regions at the sides of the print head 4. With 1920 nozzles, a unit of a Barker sequence 34 of length 13 can include 147 pixels. This corresponds to a length of 3.112 mm with a printed resolution of 1200 DPI. The correlations between printed Barker sequences 34 from different print heads 4 directly produce a measure for the displacement between print heads 4. FIG. 11 shows Barker codes 34 of length 13 from the above table fitted into the core region of print heads 4. An example of how the codes are segmented in the images and correlated with one another, on the other hand, is shown in FIG. 12. The maximum in a correlated signal 33 of two Barker sequences 34 directly indicates the displacement of the sequences relative to one another in pixel units. Pixels can be converted very precisely with printed equidistant lines into metric coordinates. The method can be used for the determination of the Y-stitchings, whereby the sequences are rotated through 90°. FIG. 13 shows in the left-hand illustration a two-dimensional pattern 28, which is composed of two Barker sequences which are put together perpendicular to one another. With such a sequence 28, it is also possible to detect a rotation of a print head 4. A rotated head leads to shearing of a pattern 29 on a sheet 11. The shearing 29 is shown in the illustration in FIG. 13 on the right-hand side. Since the nozzles in a print head 4 are distributed over a two-dimensional area, gaps in the sheared image 29 emerge when a rotation occurs.

A plurality of line-scan cameras for printed sheet monitoring are integrated in many printing machines 10. The cameras detect, with small overlaps, a complete printed sheet. Printing of periodic vertical lines, such as are known from patterns for nozzle monitoring, thus permit an adjustment of print heads 4 relative to one another in a further preferred embodiment variant.

The adjustment of the print heads 4 takes place in the X-direction perpendicular to the printing direction. This process is also called X-stitching. The overlapping regions of the print heads 4 should be aligned in the grid of the print head resolution. An alignment of the grid in the Y-direction and therefore in the printing direction does not take place mechanically, but electronically, in that an output at a print head 4 is delayed (Y-stitching). In many printing machines, moreover, a rotation of individual print heads perpendicular to the X-direction and Y-direction is possible. This adjustment option is called a Z-rotation.

Figure 9:
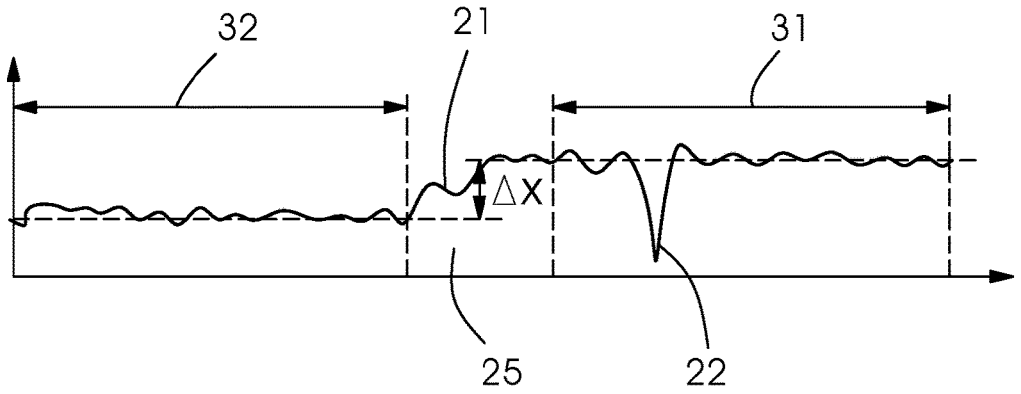
FIG. 9 is a diagram of an example of an X-stitching error by signal displacement.

In addition, a rotation of a print beam with all of the print heads is possible. Furthermore, in the case of the register adjustment, the X-displacements and Y-displacements of the individual color extractions relative to one another should be aligned. A Z-rotation of the entire print beam in turn has an effect on the X-stitching and Y-stitching of the print heads. The X-stitching can be adjusted in a favorable manner by a measurement of periodic vertical, equidistant lines. FIG. 9 represents the deviations between the setpoint and actual positions in a further diagram for phase errors 22. Phase errors 22 are constant for a print head due to the precise division of the print head and a CCD sensor in the core region of a print head 4. A maladjusted print head 4 appears in the transition region by a deviation 21 from X.

Figure 10:
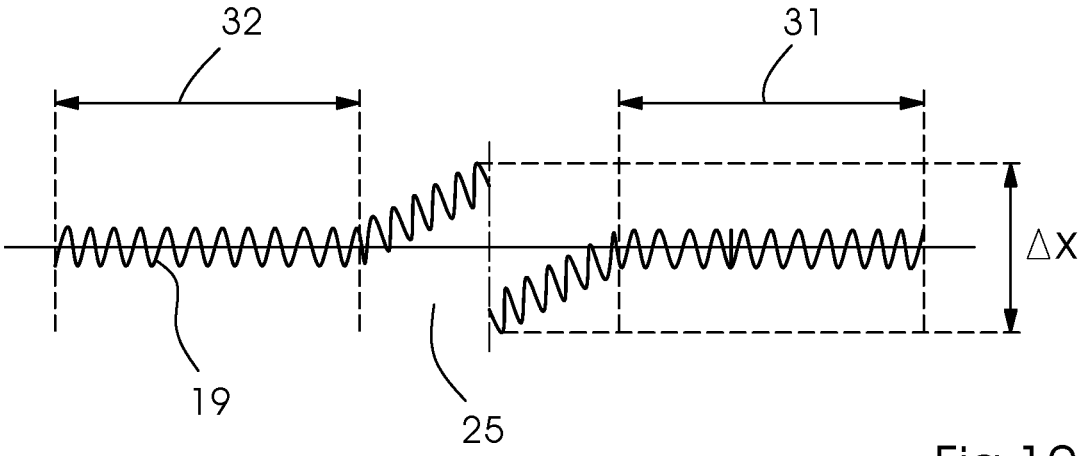
FIG. 10 is a diagram of an example of an X-stitching error by filtration of the correlation.

On the other hand, a further preferred embodiment for the position determination of print heads 4 for the adjustment is represented in FIG. 10. This is used if the optics of the camera are not sufficiently precise for the approach represented in FIG. 9. In a transition region 25 between the region of first and second print heads 31, 32, the deviation of X can be determined in a correlation signal 19 by calculation from the phase error and the filter for the correlation. The jump in the correlation signal 19 results due to the deviation of the print heads, which are reflected in a deviation of the equidistant printed lines. In the calculation of the correlation signal 19, a plurality of adjacent equidistant printed lines, acquired by the camera, are evaluated in each case. The deviation of the lines, which are printed in the stitching region by the respectively position-displaced adjacent printing head, cause the jump in the correlation signal 19. This occurs, since ever more adjacent, displaced lines are slowly taken into account in the evaluation, until the signal collapses and is then slowly normalized again, the fewer the lines taken into account by the preceding print head.

The resolution of a print head 4 is exactly known. A determination of an unknown optical image is possible with lines printed equidistant. A phase error 22 can thus be converted to a precise metric length measure. Suitable methods from signal evaluation permit singular disruptions to be taken into account, such as are caused for example by so-called oblique jetters. Finally, it is crucial for the accuracy of the measurements that many measurements inside the core regions of print heads 4 produce a high measurement accuracy even with a comparatively low camera resolution. Since the transition regions of print heads 4 are known in relation to the camera, interfering influences from these regions can easily be removed. The Y-stitching can be detached with the same principle as the X-stitching, except that the positional errors from different image columns are compared with one another, instead of the positional errors in an image line. In order to ascertain the Z-rotation error, the fact is used that lines printed in the printing direction change their mutual spacings during a Z-rotation. The change in the line spacing can be calculated from the position of the printing nozzles relative to the point of rotation of the print head 4 or of the print beam. In the reversal of motion, the rotation angle can be calculated from the nozzle-accurate measurement of line spacings in a given line pattern. Whereas the X-stitching error scarcely has any influence on the y-stitching error and z-rotation error, Y-stitching and z-rotation have a strong mutual influence on one another. A Z-rotation error of the print beam leads for example to a Y-stitching error variable over the print beam width. Through the use of a regression of the Y-stitching error over the beam width, the Z-rotation error of the print beam can be ascertained and compensated for. The Y-stitching errors of the print heads are then changed by the correction of the z-rotation error of the print beam.

The printed resolution with many inkjet printing machines 10 is currently higher than an image resolution of the cameras used for the image control. No methods from the prior art thus produce in a first step, from sub-images, a total image which is then evaluated. Due to the lower image resolution, the images have to be aligned with one another with subpixel accuracy. This requires a precise geometrical calibration of the sub-images as well as a large amount of computing time. Such a procedure is acceptable for quality control in the sense of a visual examination of a printed product 11, since a perceptible optical resolution for the user lies well below the printing resolution. However, if the measurements are to be used to correct the printing process, a high measurement accuracy is then required.

Therefore, in a further preferred embodiment variant, the drawbacks of producing a total image are avoided in that all of the required magnitudes are determined directly from the individual sub-images. A geometrical coupling of the sub-images takes place by way of printed reference marks. Correct assignments of the line elements to specific nozzles are thus also possible with images from a central part of a nozzle pattern. These reference marks are printed with a high resolution and serve as a pattern for reference systems for the geometrical calibration of the cameras. The method determines all of the geometrical magnitudes in relation to printed or otherwise determined reference systems. Such reference systems can arise from limits of the printing substrate or marks in the printing machine. A pixel-accurate detection of geometrical patterns with respect to the reference systems is possible inside a sub-image. The measured values are not distorted by a prior interpolation during a separate alignment of the sub-images to form a total image. Alternatively, a calibration of the cameras relative to one another is possible with special devices. Since the locations of the cameras relative to one another in a printing machines 10 do not change, information concerning reference systems can also be persistently stored.

The reference marks are detected by the given camera only in a roughly known region. The reference marks are therefore created in such a way that individual nozzle errors do not have a great influence on the position determination of the reference marks. For example, the emphasis of all of the pixels can be formed in the case of a circle. The reference marks can also be used to determine an orientation.

The following is a summary list of reference numerals and the corresponding structure used in the above description of the invention:

T transport direction
1 feeder
2 printing unit
3 delivery
4 inkjet heads
5 transfer cylinder
6 drive
7 printing cylinder (jetting cylinder)

8 sheet retaining zone
9 channel
10 sheet-fed printing machine
11 sheet
12 print image
13 white line
14 nozzle test pattern for a print colour
15 vertically printed, equidistant lines
16 detection of the horizontal line and averaging over the vertical lines
17 averaged original signal
18 interpolated original signal
19 start of a Fourier-transformed correlation signal
20 phase error diagram of a Fourier-transformed actual signal
21 offset deviation in the transition region between two print heads
22 phase error
23 amplitude error diagram of a Fourier-transformed actual signal
24 amplitude error
25 signal region in the transition between two print heads
28 combined two-dimensional Barker sequence
29 combined two-dimensional Barker sequence sheared
30 controller or computer
31 region of the first print head
32 region of second print head
33 representation of a correlation of two Barker sequences
34 Barker sequence

The invention claimed is:

1. A method for detecting printing nozzle errors caused by failed nozzles in an inkjet printing machine by using a computer, the method comprising the following steps:

printing a nozzle test pattern having a specific number of horizontal rows of periodically vertically printed, equidistant lines, the rows being disposed below one another and limited by horizontal lines, and in each row of the nozzle test pattern, the printing nozzles corresponding to a specific number of the horizontal rows contributing only periodically to the nozzle test pattern;

determining precise positions of individual components of the nozzle test pattern;

using at least one camera to acquire and record the nozzle test pattern;

producing an actual signal from the printed and acquired nozzle test pattern;

using the generated actual signal to carry out a Fourier analysis;

generating a reference signal with a location frequency of the Fourier-transformed actual signal;

generating a correlation signal from the reference and actual signals, the correlation signal describing valid setpoint positions for specific points of the nozzle test pattern, the specific points being the vertically printed equidistant lines;

eliminating all positions at edges of the correlation signal not corresponding to any setpoint positions;

displacing the reference signal to each of the setpoint positions, resulting in a working point at an average extreme value of the reference signal;

calculating at least one of amplitude or phase or variance errors caused by the failed nozzles from an evaluation of a signal course of the actual signal around the respective working point; and evaluating printing nozzle quality from the calculated amplitude, phase and variance errors caused by the failed nozzles.

2. The method according to claim 1, which further comprises determining the positions of the individual nozzle test patterns by detection of horizontal lines and averaging over vertical lines.

3. The method according to claim 1, which further comprises providing the nozzle test pattern with ten horizontal rows of printed patterns with a monotonic autocorrelation function.

4. The method according to claim 3, which further comprises providing the printed patterns with Barker codes having positive end values respectively at a beginning and an end of a horizontal row.

5. The method according to claim 3, which further comprises providing the printed patterns as a two-dimensional pattern being formed by two Barker codes perpendicular to one another.

6. The method according to claim 3, which further comprises providing the printed patterns with Neumann-Hoffman sequences having positive end values respectively at a beginning and an end of a horizontal row.

7. The method according to claim 1, which further comprises printing a nozzle test pattern for each print color involved in a printing process and placing the nozzle test patterns thus produced below one another to form a total test pattern.

8. The method according to claim 1, which further comprises generating the actual signal by averaging all of the horizontal rows of the nozzle test pattern, and then carrying out an interpolation of the actual signal including a reduction of artifacts arising due to a geometrical quantization by using sub-pixeling.

9. The method according to claim 1, which further comprises including a ratio of maximum values of the setpoint signal and the actual signal in the amplitude error, and detecting missing or faintly-printing printing nozzles by an evaluation of the amplitude error.

10. The method according to claim 1, which further comprises using the phase error to describe a deviation of an emphases, in a form of equivalently segmented regions, of the setpoint and the actual signal, and detecting obliquely jetting printing nozzles by an evaluation of the phase error.

11. The method according to claim 1, which further comprises determining a position of at least two print heads from the phase error by calculating displacements of the phase error in transition regions of the at least two print heads, and using the position determination for an evaluation of the print head positions in terms of an incorrect adjustment position of the at least two print heads.

12. The method according to claim 11, which further comprises carrying out the position determination of the at least two print heads by detecting a displacement of base signal values in the generated Fourier-transformed signal in the transition region, and a deviation of the adjustment positions of the two print heads disposed beside one another arising from the numerical displacement of the base signal values in the generated Fourier-transformed signal.

13. The method according to claim 11, which further comprises detecting the position determination of the at least two print heads by a displacement of base signal values in the generated Fourier-transformed signal in the transition region, and a deviation of the adjustment positions of the two print heads disposed beside one another being calculated from the phase error and a filter for the correlation signal.

14. The method according to claim 11, which further comprises using the determined print head positions for the adjustment correction of the at least two print heads at least one of perpendicular to a printing direction corresponding to a hypothetical x-axis, or in a printing direction corresponding to a hypothetical y-axis, or in an angular orientation corresponding to a hypothetical z-axis.

15. The method according to claim 14, which further comprises bringing about the adjustment correction of the at least two print heads perpendicular to the printing direction and in the angular orientation by a mechanical displacement of the at least two print heads, and carrying out the adjustment correction of the at least two print heads in the printing direction electronically by a time-delayed output of printing data to the at least two print heads.

16. The method according to claim 14, which further comprises carrying out the adjustment correction of the at least two print heads perpendicular to the printing direction and in the printing direction by evaluating the periodically vertically printed, equidistant lines being the printed patterns with a monotonic autocorrelation function in the transition region between two print heads, in the case of the adjustment correction of the at least two print heads in the angular orientation, and evaluating the periodically vertically printed, equidistant lines being the printed patterns with the monotonic autocorrelation function in the core region of the at least two print heads.

17. The method according to claim 1, which further comprises using a plurality of sub-cameras for the acquiring and recording of the nozzle test pattern, using individual images resulting from the acquiring and recording to constitute a basis for the method for detecting printing nozzle errors, and determining magnitudes required for the method directly from individual sub-images.

18. The method according to claim 17, which further comprises using printed reference marks to geometrically couple the individual sub-images to one another, causing at least one reference mark to be present in each sub-image and simultaneously using the reference marks as a pattern for a reference system for geometrical calibration of the sub-cameras.

19. The method according to claim 18, which further comprises including a circle in the printed reference mark, and fitting a center point and a diameter of the circle by using detected edge pixels thereof using a regression method.

20. The method according to claim 18, which further comprises providing information from a plurality of printing nozzles in the reference mark, and the plurality of printing nozzles belonging to a single print head.

21. The method according to claim 18, which further comprises integrating the printed reference mark into a printed measurement mark for at least one of color measurement or register control.

* * * * *